US006983568B2

(12) United States Patent
Chapman et al.

(10) Patent No.: US 6,983,568 B2
(45) Date of Patent: Jan. 10, 2006

(54) GROUND ANCHOR

(76) Inventors: James P. Chapman, 16026 Pool Canyon Rd., Austin, TX (US) 78734; Shelby M. Withrow, P.O. Box 146, Paradise, TX (US) 76073

( * ) Notice: Subject to any disclaimer, the term of this patent is extended or adjusted under 35 U.S.C. 154(b) by 74 days.

(21) Appl. No.: 10/411,456

(22) Filed: Apr. 10, 2003

(65) Prior Publication Data

US 2004/0200155 A1 Oct. 14, 2004

(51) Int. Cl.
*E02D 5/80* (2006.01)

(52) U.S. Cl. ..... 52/155; 52/162; 52/163; 248/156

(58) Field of Classification Search ..... 52/155, 52/162, 163, 165; 248/530, 156
See application file for complete search history.

(56) References Cited

U.S. PATENT DOCUMENTS

| | | | | | |
|---|---|---|---|---|---|
| 1,086,053 | A | * | 2/1914 | Howell | 52/162 |
| 1,178,282 | A | * | 4/1916 | Wilcox | 52/163 |
| 1,376,854 | A | | 5/1921 | Bearse | |
| 2,771,163 | A | * | 11/1956 | Mafera, Jr. | 52/153 |
| 2,784,815 | A | | 3/1957 | Larson | |
| 2,841,256 | A | | 7/1958 | Clevette, Jr. | |
| 3,888,057 | A | | 6/1975 | Zubke | 52/163 |
| 3,969,854 | A | | 7/1976 | Deike | 52/163 |
| 4,023,314 | A | | 5/1977 | Tanner | 52/23 |
| 4,096,673 | A | | 6/1978 | Deike | 52/156 |
| 4,300,857 | A | | 11/1981 | Santamaria | 405/70 |
| 4,611,446 | A | | 9/1986 | Beavers et al. | 52/163 |
| 4,688,360 | A | | 8/1987 | Luong et al. | 52/166 |
| 4,727,693 | A | | 3/1988 | Rockenfeller et al. | 52/163 |
| 4,738,063 | A | | 4/1988 | Alsop | 52/163 |
| 4,802,317 | A | | 2/1989 | Chandler | 52/163 |
| 5,031,370 | A | | 7/1991 | Jewett | 52/163 |
| 5,050,355 | A | * | 9/1991 | Pildysh | 52/163 |
| 5,171,108 | A | | 12/1992 | Hugron | 405/259.1 |
| 5,175,966 | A | | 1/1993 | Remke et al. | 52/163 |
| 5,620,277 | A | * | 4/1997 | Cole et al. | 404/10 |
| 5,623,843 | A | * | 4/1997 | Sands | 70/234 |
| 5,625,984 | A | | 5/1997 | Chapman et al. | 52/166 |
| 5,881,506 | A | | 3/1999 | Chapman et al. | 52/166 |
| 6,237,289 | B1 | * | 5/2001 | Jewett et al. | 52/163 |
| 6,474,028 | B2 | * | 11/2002 | Cusimano et al. | 52/153 |
| 6,572,308 | B1 | * | 6/2003 | Busto | 405/259.1 |
| 6,606,829 | B2 | * | 8/2003 | Benincasa et al. | 52/155 |

FOREIGN PATENT DOCUMENTS

| | | |
|---|---|---|
| JP | 577784 | 5/1982 |

* cited by examiner

*Primary Examiner*—Ramon O. Ramirez
*Assistant Examiner*—Steven Marsh
(74) *Attorney, Agent, or Firm*—Baker Botts L.L.P.

(57) ABSTRACT

A ground anchor (10) for anchoring a structure to the ground includes an anchor shank (15) having a connection point (18) at which a connecting member, such as a chain (19) is coupled to the anchor shank (15). An anchor body (12) is pivotally connected to the anchor shank (10) at a point (14) remote from the connection point (18).

11 Claims, 2 Drawing Sheets

GROUND ANCHOR

TECHNICAL FIELD OF THE INVENTION

This invention relates generally to anchoring systems, and more particularly to a ground anchor.

BACKGROUND OF THE INVENTION

Ground anchors are used in a wide variety of applications, both on dry land and under water, for example in anchoring antennae or floating structures, such as docks.

Ground anchors are generally driven lengthwise into the ground (either directly or through pre-drilled holes) and then pulled upward when the desired depth has been reached. The pulling action results in tilting the anchor into a generally transverse position for the anchoring function. The tilting occurs about a pivot point. With conventional anchors, a connection feature (such as a socket, padeye, or shackle, among others) may be formed at the pivot point for coupling to a connecting rod, cable, or chain ("connecting member"). The connecting member typically connects the anchored structure to the anchor.

Such conventional anchors are exemplified in the following U.S. patents: U.S. Pat. No. 5,171,108 issued to Hugron on Dec. 15, 1992; U.S. Pat. No. 5,050,355 issued to Pildysh on Sep. 24, 1991; U.S. Pat. No. 5,031,370 issued to Jewett on Jul. 16, 1991; U.S. Pat. No. 4,802,317 issued to Chandler on Feb. 7, 1989; U.S. Pat. No. 4,738,063 issued to Alsop on Apr. 19, 1988; U.S. Pat. No. 4,727,693 issued to Rockenfeller, et al. on Mar. 1, 1988; U.S. Pat. No. 4,688,360 issued to Luong, et al. on Aug. 25, 1987; U.S. Pat. No. 4,611,446 issued to Beavers, et al. on Sep. 16, 1986; U.S. Pat. No. 4,096,673 issued to Deike on Jun. 27, 1978; U.S. Pat. No. 3,969,854 issued to Deike on Jul. 20, 1976; and U.S. Pat. No. 3,888,057 issued to Zubke on Jun. 10, 1975.

With conventional anchors, the bulk of material needed to form the connection feature is frequently added to the pivot point. Because the pivot point often has a significant cross-section in and of itself, the addition of the connection feature results in an even larger cross section. Such large cross sections result in difficult insertion of anchors into the ground, and often require the drilling of holes of diameters sufficient to accommodate the enlarged cross section of the combination pivot point and the connection feature.

Furthermore, the weakest point of a ground anchor is generally at the pivot point, since this is where force is exerted between the connecting member and the anchor. Therefore, the strength of the anchor will generally be determined by the type of material and geometry of the pivot point. With conventional systems, the connecting member is attached at the pivot point, and thus the connection feature is formed at the pivot point. Such features can reduce anchor strength, since they are formed at the weakest point, unless the anchor is appropriately sized up.

SUMMARY OF THE INVENTION

Therefore, a need has arisen for a ground anchor that is relatively stronger for its size than conventional anchors, thus allowing for easier driving of the anchor into the ground. In particular, a need has arisen for a ground anchor that can be driven into narrower holes, since narrower holes can be drilled into the ground more quickly and at less cost than wider holes.

One aspect of the present invention includes a ground anchor which substantially eliminates or reduces disadvantages and problems associated with conventional ground anchors. In particular, an anchor is provided for anchoring a structure to the ground. The anchor may be coupled to the structure through a connecting member. The anchor includes an anchor shank having a first end and a second end. The first end provides a driving surface for the anchor. A connection feature may be positioned proximate the first end that is remote from the driving surface and offset from a central axis of the anchor shank. The connection feature typically couples the connecting member to the anchor shank. A pivot slot having a lock feature may be positioned proximate the second end and offset from the central axis of the anchor shank in the same direction as the connection feature. The pivot slot may be disposed substantially in-line with the connection feature. The anchor may also include an anchor body pivotally connected to the anchor shank at the pivot slot. The anchor body preferably includes a first end and a second end. The first end of the anchor body may be formed with an angled portion that extends away from the central axis of the anchor shank in the same direction as the offset of the connection feature. The angled portion preferably engage the ground when the anchor is set. A pivot pin may be disposed intermediate the first end and the second end. The pivot pin is preferably formed to couple with the lock feature of the pivot slot at a predetermined position when the anchor body is pivoted relative to the anchor shank. The anchor may include a pre-set state in which the anchor body may be pivoted in the pivot slot to be parallel with the anchor shank, such that the first end of the anchor body extends towards the first end of the anchor shank and is substantially in-line with the connection feature and the pivot slot. The anchor may include a set state in which the anchor body is pivoted in the pivot slot to no longer be parallel with the anchor shank, wherein the pivot pin couples to the lock feature of the pivot slot.

In another embodiment, a method of inserting a ground anchor into the ground includes depositing the anchor beneath a ground surface. The method further includes applying a pulling operation to an anchor shank, such that an anchor body pivots about the anchor shank to allow a pivot pin on the anchor shank to engage a lock feature on the anchor body. Upon pivoting the anchor body to a predetermined position, the method automatically interlocks the pivot member on the anchor body to the locking feature on the anchor shank.

In a further embodiment, a hollow passage may be formed in the anchor for coupling with a fluid (e.g., water) supply to allow jetting operations for easier insertion into the ground.

Important technical advantages of the present invention include an anchor shank which may be used to lock the anchor body into a substantially perpendicular position in relation to the anchor shank. The locking feature allows the anchor to maintain a large surface area against the ground to prevent undesired removal of the anchor. In addition, the lock feature on the anchor may prevent the anchor body from over-rotating with respect to the anchor body, which may cause the anchor body to align substantially parallel with the anchor shank.

Another important technical advantage of the present invention includes a reduced anchor profile for driving the anchor into the ground. Because the anchor body is placed substantially parallel to the anchor shank when the ground anchor is being driven into the ground, the ground anchor may be inserted into a narrow hole. Thus, the ground anchor may be less costly to use over conventional anchors.

A further important technical advantage of the present invention includes one or more fluid flow paths to direct the passage of fluids for jetting operations associated with easier insertion into the ground.

All, some, or none of these technical advantages may be present in various embodiments of the present invention. Other technical advantages will be apparent to one skilled in the art from the following figures, descriptions, and claims.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The preferred embodiment of the present invention and its advantages are best understood by referring to FIGS. 1 through 5 of the drawings, like numerals being used for like and corresponding parts of the various drawings.

Figure 1:
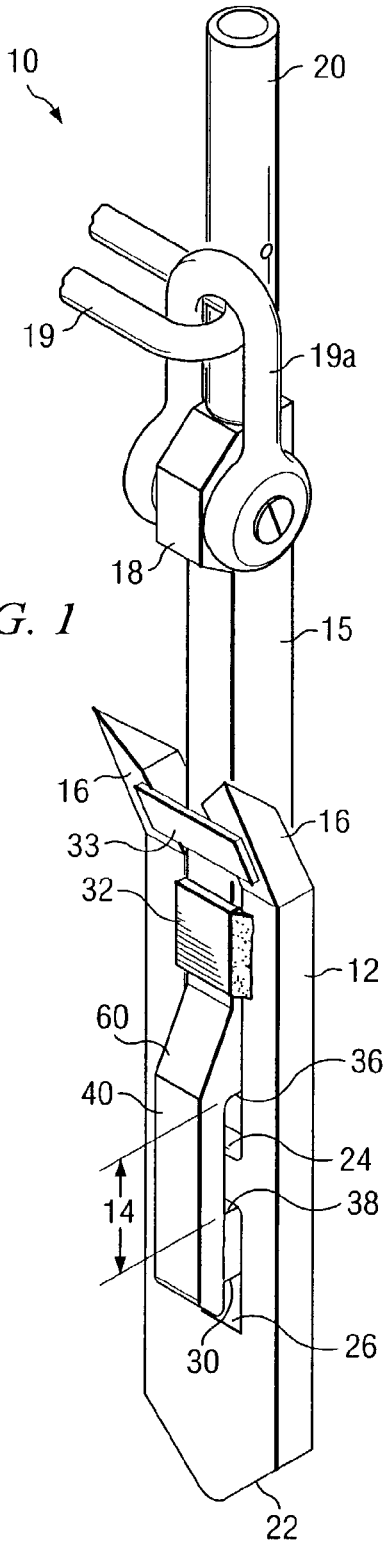
FIG. 1 is a schematic drawing showing a perspective view of a ground anchor according to the teachings of the present invention.

FIG. 1 illustrates a perspective view of ground anchor 10 according to the teachings of the present invention. Ground anchor 10 of the present invention may be made of any suitable material, including, but not limited to, cast iron, stainless steel, or any combination of suitable materials or alloys. As shown in FIG. 1, ground anchor 10 of the present invention includes an anchor shank 15 pivotally connected to an anchor body 12 at pivot location 14. Anchor body 12 includes end 16. End 16 initiates, upon pulling of ground anchor 10 after it has been inserted in the ground, the pivoting of anchor body 12. In particular, ends 16 engages with the ground upon the pulling operation, resulting in the pivotal action.

Also shown in FIG. 1 is padeye 18 formed on anchor shank 15 remote from pivot point 14. Padeye 18 provides a connection feature for coupling a connecting member chain 19 (as illustrated in the FIGURES) to ground anchor 10. The connecting member is used to connect ground anchor 10 to the structure to be anchored. It should be understood that any type of connecting member, such as a rod, cable, rope, chain 19, or any other suitable connection member, can be used for connecting ground anchor 10 of the present invention with a structure (not expressly shown) to be anchored. Thus, the padeye 18 shown in FIG. 1 is exemplary only, and other types of connection features, such as screw fittings for threaded connecting rods, or any other type of connection fitting, can be used without departing from the intended scope of the present invention. It is important only that the connection feature be remote from the pivot point 14.

By providing a connection point that is remote from the pivot point 14, the present invention provides a significant advantage over conventional systems. In particular, the bulk of material required to form the connection feature (such as padeye 18) is placed remote from the pivot point 14, and therefore the cross section of ground anchor 10 of the present invention (for purposes of insertion) is greatly reduced over that of conventional systems. This advantage results because the pivot point of a typical ground anchor has a significant cross section in and of itself, and thus placing the connection point at the pivot point, as in conventional systems, presents an even larger cross section. With the present invention, the cross section attributable to the connection feature is placed "in line" with that of the pivot point, and is thus not added to that of the pivot point. Therefore, ground anchor 10 of the present invention can be inserted into the ground more easily, and in particular into holes of smaller diameters, than many conventional systems. The ability to be inserted into holes of smaller diameters provides a significant advantage, since smaller holes can be drilled for less cost and more quickly than wider holes. For example, in one embodiment, ground anchor 10 may be inserted into a hole with a diameter of approximately three-inches. The present invention provides cross sectional reductions over anchors of comparable strength on the order of fifty percent or more.

Figure 2:
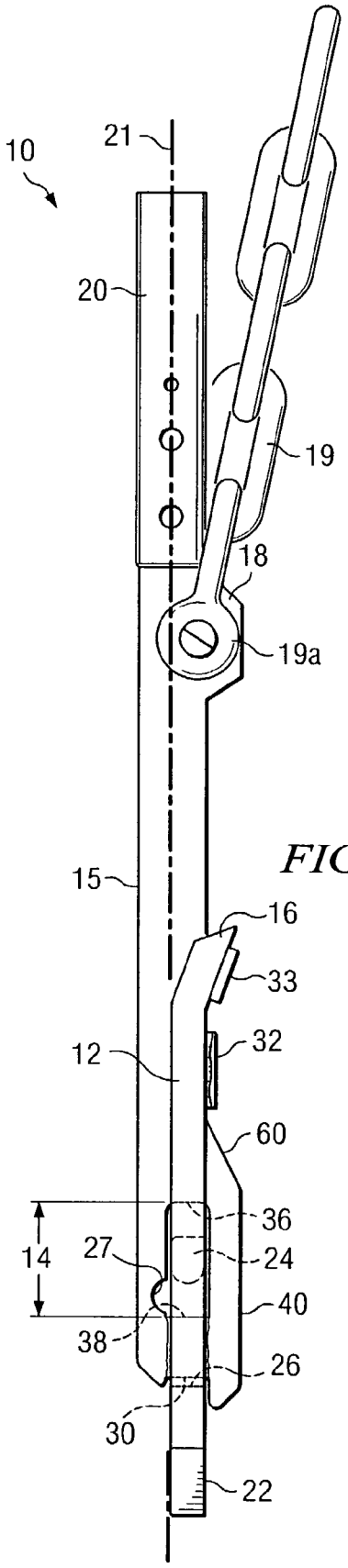
FIG. 2 is a schematic drawing showing a side view of a ground anchor according to the teachings of the present invention in a first position before the anchor is set.
Figure 3:
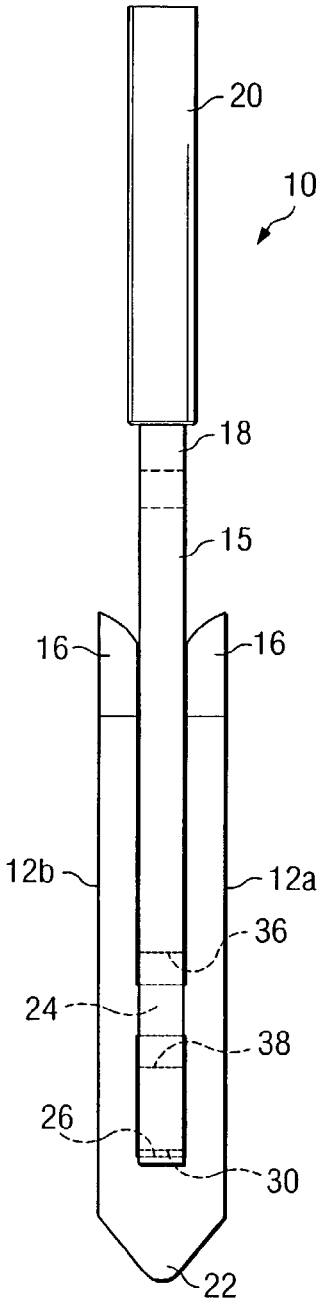
FIG. 3 is a schematic drawing showing a front view of a ground anchor according to the teachings of the present invention before the anchor is set.
Figure 4:
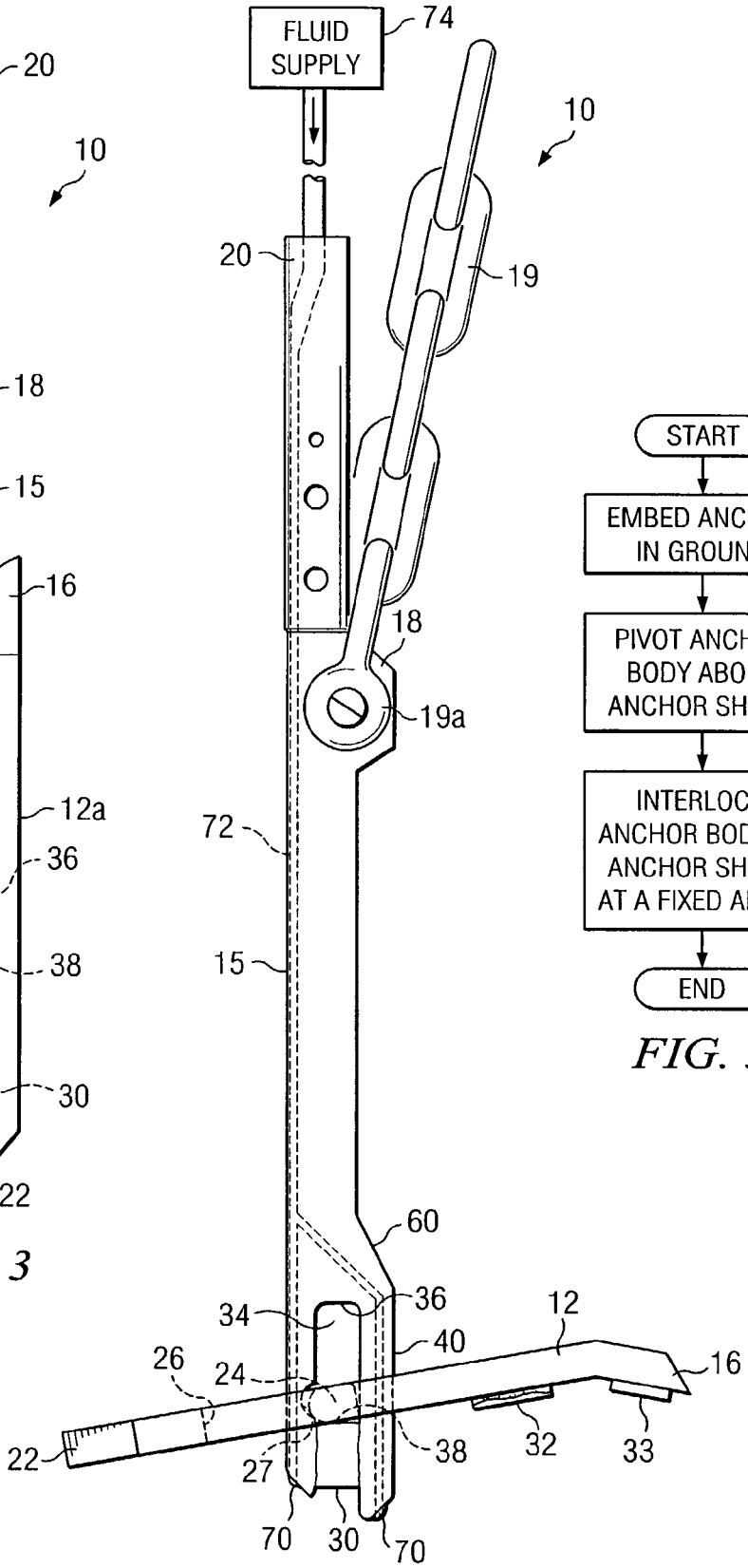
FIG. 4 is a schematic drawing showing a side view of a ground anchor according to the teachings of the present invention in a second position after the anchor is set.

FIGS. 2–4 illustrate particular views of ground anchor 10 according to the teachings of the present invention. FIGS. 2 and 3 illustrate ground anchor 10 in a first position before it has been set, while FIG. 4 illustrates ground anchor 10 in a second position after it has been set. As shown in these FIGUREs, the anchor shank 15 includes adapter 20 for use in coupling an applicator, or insertion device (not expressly shown), to the anchor shank 15, for use in driving ground anchor 10 into the ground. Adapter 20 may be any fitting, socket, or other adapter satisfactory to receive a driving device, such as a jackhammer. For some applications, adapter 20 may be a threaded fitting. In addition, the connection feature may be positioned proximate adapter 20 that is remote from the driving surface or leading end 22 and offset from central axis 21 of anchor shank 15.

As shown in the FIGUREs, anchor body 12 includes a leading end 22, which joins anchor body members 12*a* and 12*b*. Leading end 22 may be beveled, pointed, or angled to accommodate insertion into the ground. Anchor body 12 also includes a pivot pin 24 for providing the pivotal connection with anchor shank 15. Pivot pin 24 may be formed integrally with or separate from anchor body 12. Leading end 22 includes anchor body shoulder 26. Anchor body shoulder 26 may engage with recessed driving shoulder 30 of anchor shank 15. Recessed driving shoulder 30 allows the anchor body 12 to "lock" into anchor shank 15 during insertion of ground anchor 10 into the ground, thereby avoiding premature pivoting of the anchor body 12 about anchor shank 15. Anchor shank 15 and slot cap 40 preferably extend beyond recessed driving shoulder 30.

Because of recessed driving shoulder 30 discussed above, the pivotal connection formed between anchor shank 15 and anchor body 12 of the present invention provides an important technical advantage. In particular, during insertion or driving of ground anchor 10 into the ground, anchor body 12 "locks" into anchor shank 15, thus avoiding premature setting of the anchor, see FIG. 2. However, it should be understood that this feature need not be included. Furthermore, other locking mechanisms may be used without departing from the scope of the invention.

Pivot pin 24 of anchor body 12 may pivot within pivot slot 34 of anchor shank 15. When ground anchor 10 moves from its first position to its second position. Pivot slot 34 is in part defined by first shoulder 36, second shoulder 38 and slot cap 40. Pivot slot 34 in part includes a lock feature 27. Typically, lock feature 27 may be formed as a part of first shoulder 36, second shoulder 38 or slot cap 40 and may cause anchor body 12 to maintain a predetermined position in relation to anchor shank 15. Lock feature 27 may include a variety of locking devices, such as an interlocking parts, or any suitable device to prevent the rotation of anchor body 12 about anchor shank 15.

In one example embodiment, lock feature 27 includes a recessed portion (e.g., a notch) that is able to receive and "lock" pivot pin 24 into a fixed position. Generally, the rotation or pivoting of anchor body 12 about anchor shank 15 causes pivot pin 24 to couple with lock feature 27. By varying the shape of pivot pin 24 as formed on anchor body 12, anchor body 12 may rotate and "lock" via the locking feature 27 at a predetermined position in relation to anchor shank 15. For example, anchor body 12 may pivot about anchor shank 15 until reaching a predetermined position, and at such point, anchor body 12 locks into the predetermined position, such as a substantially perpendicular position (about a ninety degree angle) in relation to anchor shank 15.

Furthermore, other types of pivotal connections between the anchor shank 15 and anchor body 12 may be used without departing from the scope of the present invention. For example, anchor shank 15 could be forked, with anchor body 12 pivoting between the forks of anchor shank 15.

As shown in FIG. 3, anchor body members 12*a* and 12*b* are angled at ends 16. These ends may be beveled, or in alternate embodiments, the ends need not be beveled (not expressly shown). By beveling each end 16, the ground anchor of the present invention can be more quickly set upon the pulling action. Anchor body members 12*a* and 12*b* may also be joined at or near each end 16 with end connection member 33 to increase strength. Each end 16 may also be beveled to improve ground-engagement. Moreover, the shape or thickness of each end 16 may be varied to embodiments other than those expressly shown.

In some embodiments, angled shoulder 60 is provided on anchor shank 15. With this embodiment, anchor body members 12*a* and 12*b* may be joined near end 16 with reinforcement block 32. Angled shoulder 60 facilitates pivoting of anchor body 12 because it is angled in the direction end 16 pivots. In particular, when the end 16 engages with the ground during setting of the anchor, the angled shoulder 60 contacts a portion of reinforcement block 32 and directs anchor body 12 in the pivoting direction.

In some embodiments, anchor body 12 may be reinforced in a manner, which enhances its strength without increasing its clearance requirements. This is accomplished by attaching reinforcement block 32 across anchor body members 12*a* and 12*b* on the same side that the prongs of ends 16 extend away from the planar surface. Reinforcement block 32 may engage angled shoulder 60. Additional reinforcement may be achieved by attaching other reinforcing blocks (not expressly shown) on the face anchor body 12 opposite reinforcing block 32 that lie along the sides of anchor body 12 perpendicular with and adjacent to pivot pin 24. When ground anchor 10 is in the set state, reinforcement is supplied proximate the center of anchor body 12, thus reducing the risk of buckling.

When the anchor body 12 is positioned in the preset state, it is essentially parallel with the anchor shank 15. Once ground anchor 10 has been driven into the ground to the desired depth, tension is applied to the connection member or chain, which causes anchor shank 15 to be pulled upward. This upward movement causes ends 16 of anchor body 12 to engage the ground and force the anchor body 12 to pivot about pivot pin 24. In one embodiment, this pivoting action may be initiated or encouraged when angled shoulder 60 encounters reinforcing block 32 as the anchor shank 15 is pulled upward. Angled shoulder 60 forces anchor body 12 to rotate such that ends 16 are forced outward from central axis 21 of ground anchor 10, thus encouraging engagement with the ground and transition from the pre-set state to the set state.

An added improvement may include reduced cost and complexity of manufacturing ground anchor 10. In the illustrated embodiment, anchor shank 15, anchor body 12, end connection member 33, and reinforcing block 32, may be cut from a sheet of metal or from flat metal pieces. For example, reinforcing block 32 may be formed from flat metal and attached to anchor body 12 by welding or another attachment process. The metal sheet or pieces may be scrap iron, stainless steel, or any other similar metal, and the metal sheet or pieces may vary in thickness. In one embodiment, sheet metal of one-inch thickness is used.

Figure 5:
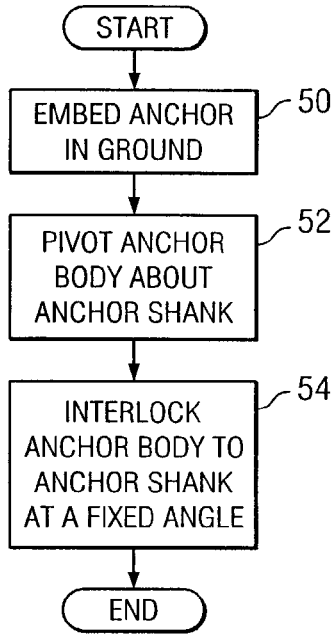
FIG. 5 is a method of inserting a ground anchor into the ground according to the teachings of the present invention.

FIG. 5 is a method of inserting ground anchor 10 into the ground. At step 50, the method embeds or deposits ground anchor 10 beneath the ground. Typically, ground anchor 10 may be inserted into a pre-drilled hole. However, in some embodiments, no pre-drilled hole is needed. As such, an applicator tool (not expressly shown) may be coupled to anchor shank 15, for example at adapter 20. This applicator tool may attach to adapter 20 for receiving a driving tool, such as a jackhammer.

In operation, a hole is drilled, and applicator tool is coupled to anchor shank 15. Also, the connecting member for connecting ground anchor 10 to the structure to be anchored is coupled to the anchor shank 15. In one particular example, this connecting member may be chain 19 connected to padeye 18, with shackle 19*a*. The driving instrument, such as a jackhammer, is coupled to the applicator tool and used to drive ground anchor 10 into the pre-drilled hole.

Once ground anchor 10 is inserted to the desired depth, the applicator tool is disengaged from adapter 20, such as by unscrewing or unpinning it. Ground anchor 10 is then "set" by pulling on the connecting member. As discussed above, this pulling operation results in ends 16 of anchor body 12 engaging with the ground, thus resulting in the pivoting of anchor body 12 to a second, transverse position (as shown in FIG. 4), at step 52.

The use of applicator tool allows for ground anchor 10 to be inserted to a greater depth than if the drive instrument were coupled directly to ground anchor 10. However, it should be understood that the applicator tool is not necessary, and the drive instrument can be coupled directly to the anchor shank 15 via adapter 20.

As anchor body 12 rotates or pivots about anchor shank 15, anchor body 12 reaches a predetermined angle or predetermined position in relation to anchor shank 15. Upon reaching the predetermined position, locking feature 27 automatically engages anchor body 12, at step 54. In one particular example embodiment, pivot pin 24 on anchor body 12 is formed to interlock with locking feature 27 on anchor shank 15 upon reaching the predetermined position. Typically, the predetermined position relates to an angle or relative position of anchor body 12 in relation to anchor shank 15. For example, a predetermined position may include a substantially perpendicular position.

Referring to FIG. 4, in certain embodiments, anchor shank 15 includes a hollow passage 72 and may further include nozzle 70 to facilitate jetting operations. By "hollow" it is meant that the piece has a channel or other void allowing for the flow of a fluid. A supply of water or air (or other fluid), fluid supply 74, may be coupled to adapter 20 to supply a fluid through the anchor shank 15 and end 16. Fluid supply 74 can be supplied through a hose or hollow driving tool, or other possible supply couplings. This process assists in clearing a passage through the ground for insertion of ground anchor 10. This jetting capability simplifies anchor insertion in many soil conditions that have previously presented significant difficulties, such as sand, clay, and mud. Indeed, the jetting advantage can be implemented without an anchor shank, for example with certain conventional anchor systems. To take advantage of the present invention's jetting capability to improve conventional anchors, the conventional anchor pieces can be hollowed and adapted to couple with a water or air supply. For example, a driving tool use an anchor with hollow passage 72 to allow a fluid to pass through the driving tool and hollowed anchor piece. Alternatively, fluid supply 74 can be coupled directly to the hollow anchor piece, for example with a hose, and the anchor can then be driven with the connecting member.

The ability to supply fluids for jetting operations avoids the need in many cases for machinery needed for driving, such as hydraulic or pneumatic hammers, and the associated hydraulic or pneumatic systems.

The particular shape of various members of the present invention may be changed without departing from the intended scope. For example, anchor shank 15 and other members may have a round, square, polygon, elliptical, or other shaped cross section.

Although the present invention has been described in detail, it should be understood that various modifications, substitutions, or alterations can be made without departing from the intended scope as defined by the appended claims.

What is claimed is:

1. An anchor operable to couple to a structure through a connecting member to the ground, the anchor comprising:

an anchor shank having a first end and a second end;

the first end providing a driving surface for the anchor;

a connection feature positioned proximate the first end of the anchor shank and remote from the driving surface, the connection feature having an offset from a central axis of the anchor shank;

a pivot slot having a lock feature defined in part by a notch;

the pivot slot positioned proximate the second end of the anchor shank;

an anchor body pivotally connected to the anchor shank by a pivot pin disposed in the pivot slot the pivot pin being configured to abut the notch upon rotation of the anchor body;

the anchor body having a first end and a second end, the first end of the anchor body formed with an angled portion that extends away from the central axis of the anchor shank in the same direction as the offset of the connection feature, the angled portion for engaging with the ground when the anchor is set;

the pivot pin disposed intermediate the first end and the second end of the anchor body, the pivot pin formed to couple with the notch associated with the lock feature of the pivot slot; and the anchor having a first position with the anchor body operable to pivot in the pivot slot to a second position with the first end of the anchor body extending towards the first end of the anchor shank and the pivot pin couples to the lock feature of the pivot slot.

2. The anchor of claim 1, wherein the second position comprises a generally transverse position, such that the anchor body may be substantially perpendicular in relation to the anchor shank.

3. The anchor of claim 1, wherein the anchor shank includes a hollow passage from the first end to the second end such that the anchor is inserted into the ground by jetting.

4. The anchor of claim 1, wherein the driving surface of the anchor shank includes a socket to facilitate insertion of the anchor into the ground.

5. The anchor of claim 1, wherein the second end of the anchor shank comprises a recessed shoulder for engaging with the anchor body.

6. The anchor of claim 1, wherein the angled portion further comprises a connection member operable to increase the strength of the angled portion.

7. An anchor for anchoring a structure to the ground the anchor comprising:

an anchor shank having a first end and a second end;

a connection feature for receiving a connecting member, the connection feature located proximate the first end of the anchor shank;

a pivot slot having a lock feature defined in part by a notch, the pivot slot positioned proximate the second end and remotely disposed from the connection feature;

an angled shoulder positioned between the connection feature and the pivot slot, the angled shoulder extending away from a central axis of the anchor shank and extending towards the second end of the anchor shank to form an acute angle;

an anchor body having a pivot pin pivotally connected to the anchor shank at the pivot slot;

the pivot pin being configured to abut the notch upon rotation of the anchor body;

the anchor body having a first end and a second end with the anchor body connected to the pivot slot intermediate the first end and the second end of the anchor body;

a cross-portion extending across the first end of the anchor body;

the anchor having a first position in which the anchor body is generally aligned parallel with the anchor shank with the first end of the anchor body extending towards the first end of the anchor shank and the cross-portion of the anchor body disposed proximate the angled shoulder of the anchor shank;

the anchor having a second position in which the anchor body is pivoted in the pivot slot to no longer be parallel with the anchor shank such that the anchor body couples to the notch associated with the lock feature of the pivot slot; and the angled shoulder of the anchor shank contacting the cross-portion of the anchor body when the anchor is in its second position such that the angled shoulder directs the anchor body in the pivoting direction.

8. The anchor of claim 7, wherein the second position comprises the anchor body extending substantially perpendicular in relation to the anchor shank.

9. The anchor of claim 7, wherein the anchor shank comprise a fluid flow pattern from the first end to the second end to accommodate inserting the anchor into the ground by jetting.

10. The anchor of claim 7, further comprising:

an applicator tool coupled to the anchor shank at the first end; and the applicator tool extending from the anchor shank to accommodate insertion of the anchor into the ground to a predetermined depth.

11. The anchor of claim 7, wherein the cross-portion of the anchor body comprises a reinforcement block.

* * * * *